United States Patent [19]

Rogosch

[11] 3,930,790

[45] Jan. 6, 1976

[54] METHOD AND APPARATUS FOR SHRINKING PLASTIC FILM OVER GROUPED ARTICLES

[75] Inventor: John E. Rogosch, Canton, Ohio

[73] Assignee: Ethyl Corporation, Richmond, Va.

[22] Filed: Apr. 8, 1971

[21] Appl. No.: 132,281

[52] U.S. Cl. ..... 432/229; 53/30; 53/184 S

[51] Int. Cl.[2] ..... B65B 53/02; F24J 3/00

[58] Field of Search ..... 53/30, 184; 431/258; 432/229, 230

[56] References Cited

UNITED STATES PATENTS

| | | | |
|---|---|---|---|
| 3,073,379 | 1/1963 | Martin | 431/258 |
| 3,508,375 | 4/1970 | Myers | 53/30 |
| 3,514,920 | 6/1970 | Hoffler et al. | 53/184 X |
| 3,572,004 | 3/1971 | Carmichael | 53/184 X |
| 3,581,458 | 6/1971 | Gustavsson | 53/30 |
| 3,589,102 | 6/1971 | Zelnick | 53/184 |

OTHER PUBLICATIONS

"New Concept in Unitized Shipping," by Seymour Zelnick - Reader Service Reprint from Modern Packaging, Apr., 1969.

*Primary Examiner*—Roy Lake
*Assistant Examiner*—E. F. Desmond
*Attorney, Agent, or Firm*—Donald L. Johnson; John F. Sieberth; E. Donald Mays

[57] ABSTRACT

A process and apparatus for shrinking plastic film over grouped articles. The apparatus includes a frame having a base and upstanding support members. A heater assembly is movably attached to the upstanding support members and is adapted to be passed over a group of products surrounded by a biaxially or preferentially oriented plastic film capable of being heat shrunk. The heater assembly carries one or more flameless, fuel gas powered, infrared heating units.

3 Claims, 6 Drawing Figures

METHOD AND APPARATUS FOR SHRINKING PLASTIC FILM OVER GROUPED ARTICLES

BACKGROUND OF THE INVENTION

1. Field of the Invention

This invention relates to a method and apparatus for shrinking plastic film around an article or a group of articles.

2. Description of the Prior Art

The use of biaxially or preferentially oriented plastic film capable of being heat shrunk has found wide application in packaging articles and groups of articles. Many apparatuses and processes are currently in use in the marketplace for wrapping articles in both uniaxially oriented and biaxially oriented plastic film. These apparatuses use film in the form of endless sheets which are cut into panels and wrapped around articles or groups of articles and also utilize performed bags which are placed over groups of articles. One area which has experienced exceptionally fast growth in the last few years is the area of pallet packaging using preformed heat shrinkable bags or sheets of plastic to surround the articles carried on a conventional pallet which can be handled by a forklift truck. At present there are generally two systems utilized for shrink wrapping palleted articles in shrink film. One system utilizes a heat tunnel wherein the palleted articles are encased either in a preformed plastic bag or are wrapped with sheets of oriented plastic and then passed through a heat tunnel where the temperature is rapidly raised to cause the plastic film surrounding the pallet to shrink tightly to the articles on the pallet and the base of the pallet itself. The second form of apparatus used is where the pallet is placed on a base, or either set on the floor, and the articles are covered by either a plastic preformed bag or by sheets of plastic material, and a heating device is passed down over or around the palleted products encased in the plastic bag, and heat is applied from the heating device to the plastic to cause it to shrink about the articles carried on the pallet. Some of these machines are relatively simple and do not require the extensive investment as do the heat tunnel type shrinking installations.

However, one of the shortcomings of the single pallet, stationary, shrink apparatuses is found in their heat application assemblies. Most of the pallet shrink apparatuses equipped with a moving heat source now utilize either open gas flames, electrical resistance heaters of the calrod type, banks of quartz heating elements, or banks of heat lamps. The prior art devices have experienced considerable difficulty in achieving a uniform heat application whereby an even and controlled shrinkage of the plastic wrap about the palleted articles occurs. Open flame shrink devices have the disadvantage that the flames are difficult to control and cannot be used in a hazardous atmosphere. Additionally, they cause burn spots and overheating of the plastic wrap on occasions. Electrical powered heaters suffer deficiencies in that they do not provide a high efficiency for the power utilized. All of the foregoing methods of applying heat to shrink film palleted articles are rather slow and involve excessive use of the energy sources such as gas or electricity.

Thus, there is a need in the field of shrink wrapping palleted articles to provide a method and apparatus which can rapidly and economically shrink a plastic film around a group of palleted articles.

SUMMARY OF THE INVENTION

It is an object of the present invention to provide a method and apparatus for efficiently shrinking plastic film around an article or a group of articles.

It is another object of the present invention to provide a method and apparatus for shrinking the film around an article or group of articles which utilizes an efficient heat source.

It is also an object of the present invention to provide an apparatus for shrinking plastic film around an article or a group of articles which utilizes an apparatus of simple construction.

It is still another object of the present invention to provide a method and an apparatus for shrinking plastic film around an article or group of articles which utilizes a portable apparatus that may be operated at any location.

It is still another object of the present invention to provide a method and apparatus for shrinking plastic film around an article or a group of articles which utilizes energy sources readily absorbed by the plastic film.

The foregoing objects and other advantages that are brought out hereinafter are realized in the apparatus aspects of the present invention in an apparatus for shrinking plastic film around an article or a group of articles which includes a support frame having a substantially vertical support member. A heater assembly is mounted on the vertical support member for up and down movement. Heater means are mounted on the heater assembly to direct heat inwardly. Power means are mounted on the support frame and coupled to the heater assembly for moving the heater assembly up and down.

The process aspects of the present invention are realized in a process for shrinking plastic around an article or group of articles which includes the steps comprising at least partially surrounding the article or group of articles with a heat shrinkable plastic film and applying infrared energy having a wavelength of from about two to about six microns.

The process and apparatus of the present invention are characterized in their use of an extremely efficient and economical heat source for the heater assembly used to shrink the film. The shrinking assembly, or heater assembly, of the apparatus utilizes a flameless hydrocarbon gas fuel, infrared heater unit for applying heat to the plastic film surrounding the packaged or grouped products. These flameless gas, infrared heaters are substantially explosion proof and may be used in some hazardous areas. Additionally, they may be used on natural gas or liquefied petroleum gas and burn without a flame. The heaters are further characterized in that they give off a very intense infrared radiant energy which is peaked in the two to six micron range. Heat in this range is readily absorbed by plastic film material such as polyethylene, polyvinyl chloride and other sheet plastic material used for shrink wrapping commodities. The apparatus is also characterized by simplicity of construction and its ready portability which permit its use at a number of sites.

DESCRIPTION OF THE PREFERRED EMBODIMENTS

Figure 1:
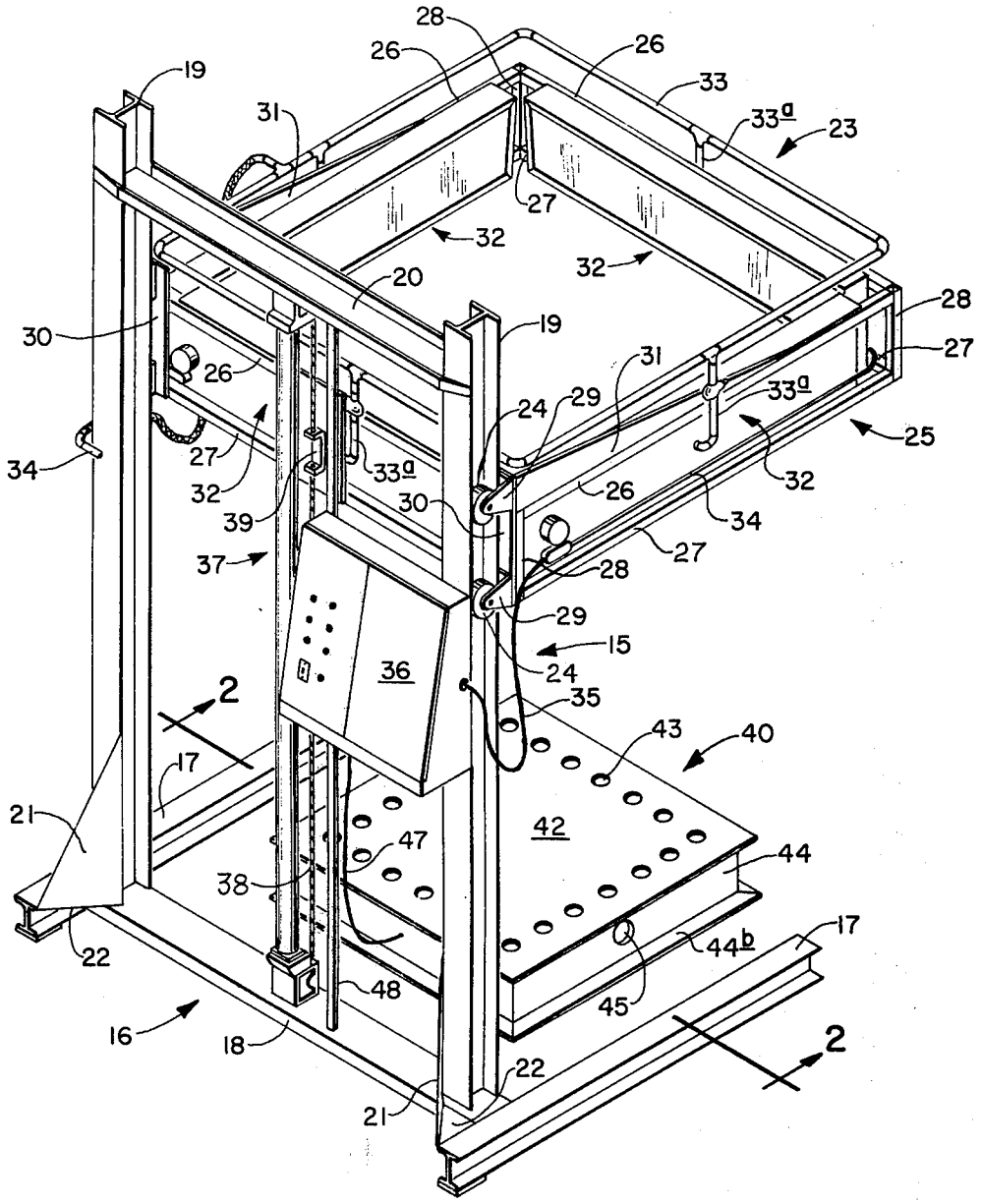
FIG. 1 is an elevational, perspective view of an apparatus for shrinking plastic film around articles constructed in accordance with the present invention.

Referring now to FIG. 1, the embodiment shown for the apparatus for shrinking plastic film over grouped articles is designated generally by the numeral 15. The device includes a base or support frame, designated generally by the numeral 16. The base or support frame is generally U-shaped and includes a pair of spaced apart, horizontally extending leg members 17—17. As shown, the leg members 17—17 can be made from steel I beams; however, any other type material or shape may be used for these members. The spaced apart leg members 17—17 are joined together near their lower end by means of cross member 18. Cross member 18 is attached to the leg members by means of welding or other suitable attachment means at a position slightly forward of the lower ends of the leg members. A pair of vertically extending, spaced apart support members 19—19 are attached at their lower ends to the cross member 18 adjacent each end thereof. The vertical support members 19—19 are preferably constructed from metal structural I beams as seen in FIG. 1 and are connected together by upper cross member 20 adjacent their upper ends. Each of the support members 19 is connected at its lower end to a leg member 17 by means of triangular brace 21 and a fillet member 22 to provide increased rigidity for the leg member 19.

A heater assembly, designated generally by the numeral 23, is movably attached to the upright support members 19—19 by means of rollers or wheels 24. A pair of rollers or wheels 24—24 are received between the outer channels of each of the I beam vertical support members 19—19 and are movable therein. The heater assembly includes a frame structure, designated generally 25, which is generally rectangular in shape. Frame structure 25 includes upper horizontal frame members 26 and lower horizontal frame members 27 which are joined together by vertically extending frame members 28 at the four corners of the rectangular frame structure. The components used for the frame members may be rectangular shaped, hollow, steel channels or solid steel structural members, if desired. Further, they may be assembled by welding or other suitable means into a rigid frame structure. A pair of wheels 24—24 on each side of the frame structure are carried by U-shaped brackets 29—29, which are welded to a reinforcing strap 30 which is, in turn, attached by welding or other suitable means to both sides of the rearmost upper and lower frame members and opposed vertical frame members. A reinforcing triangular bracket 31 is attached by welding or other suitable means to the top of the two opposed upper horizontal frame members 26—26 and is also attached to the reinforcing strap 30 to thereby provide additional rigidity for the frame structure 25 as it is moved up and down on the support members by means of the wheels engaged therewith. Instead of being rectangular in shape, the heater assembly may be circular and utilize one continuous heater element. Also, the heater assembly may utilize a single heater unit mounted vertically on the frame 25 and movable around the frame to apply heat to the plastic film covered products if desired.

The heater assembly also includes at least one generally rectangular heater unit, designated generally by the numeral 32. In the embodiment illustrated, four heater units are utilized with one heater unit being mounted on each of the inner surfaces of the rectangular frame structure 25. Each heater unit is a separate component and may be attached to the frame structure 25 by means of nuts and bolts (not shown) or other suitable means. A gas manifold 33 made of rigid pipe or other suitable conduit is mounted above the heater assembly and is connected into each of the heater units 32 by means of short connector pipes 33*a*. A flexible supply hose 34 is connected to the gas manifold 33 and is, in turn, connected at its other end to suitable pressure regulators and control valves (not shown) which are, in turn, connected to a source of gas fuel supply, e.g., natural gas, liquified petroleum gas, or manufactured gas or other suitable fuel (not shown). Each heater unit 32 is supplied with electrical power by means of electrical wires carried in conduit 34 which extends around the inside perimeter of the support frame 25. Electrical power is supplied to the wiring in the conduit by means of flexible electrical cable 35 which is connected to a source of electrical power inside control box 36.

The heater assembly 23 is moved up and down on the spaced apart support members 19—19 by means of a double-acting, pneumatic power assembly, designated generally 37. The power assembly 37 is attached at its lower end to cross brace member 18 and at its upper end to upper cross member 20 and is spaced approximately equidistant between the two vertical support members 19—19. The pneumatic power assembly includes flexible drive cable 38 which is attached to the heater ring assembly by means of bracket 39. Alternatively, the heater assembly can be moved up and down by means of an electric motor connected to a gear box which drives a chain passing over sprocket wheels instead of pulleys.

Figure 2:
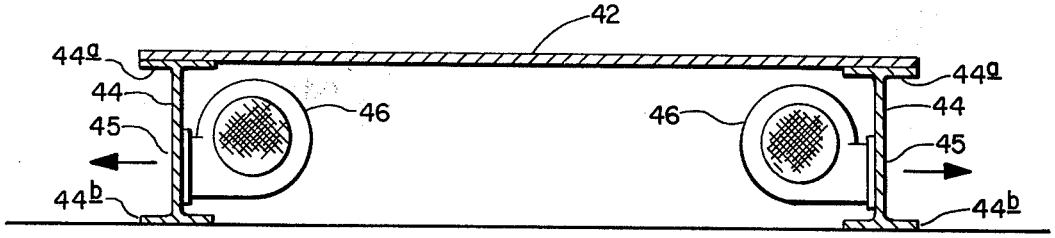
FIG. 2 is a cross-sectional view of a portion of the apparatus of FIG. 1 taken along line 2—2.

Resting on the floor between the leg members 17—17 of the base support frame is a pedestal or base, designated generally 40, adapted to support a group of products which are at least partially wrapped in plastic film. In normal practice the products will be mounted on a pallet 41, as seen more clearly in FIG. 6 The pallet pedestal 40 includes a top wall 42 having a plurality of openings 43 adjacent its perimeter as seen in FIG. 1. Attached to the underside of the top wall 42 are four sidewalls 44. As seen more clearly in FIG. 2, the sidewalls 44 terminate at their top and bottom in a T-shaped upper portion 44*a* and lower base portion 44*b* to provide increased strength and rigidity to the structure. The sidewalls 44 may be conveniently made from structural I beam steel material. The pallet pedestal has two of its opposed sidewalls 44—44 provided with openings 45 therein. As seen in FIG. 2, a centrifugal fan assembly 46 is attached to the sidewall 44 at each of the openings 45. As seen in FIG. 1, the electrical power for the pair of centrifugal fan assemblies 46—46 is supplied to the pedestal 40 through electrical cord 47 which is connected to electrical power source inside the control box 36. Electrical control box 36 is attached by welding or other suitable means to right-hand vertical support member 19 and to a vertical brace rod 48 which extends between cross members 18 and 20 and is attached thereto at its ends.

Figure 4:
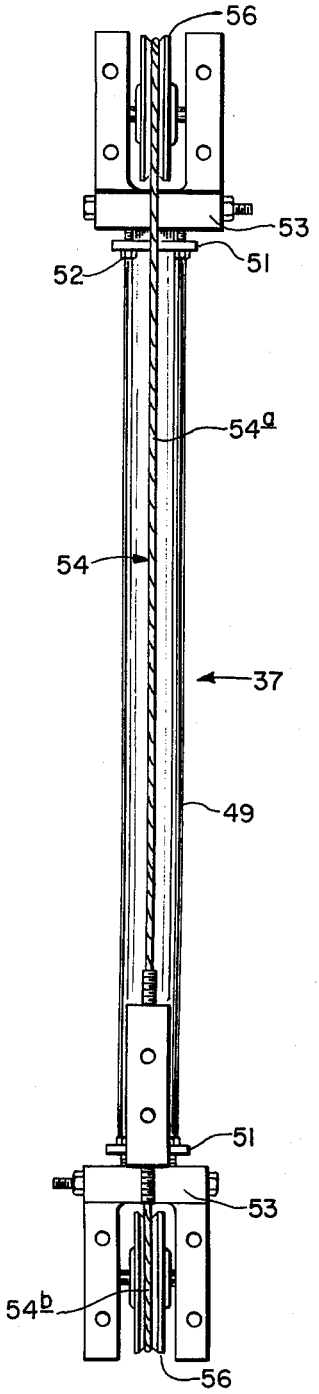
FIG. 4 is a front elevational view of the pneumatic power assembly for raising and lowering the heater assembly in the apparatus of the present invention.
Figure 5:
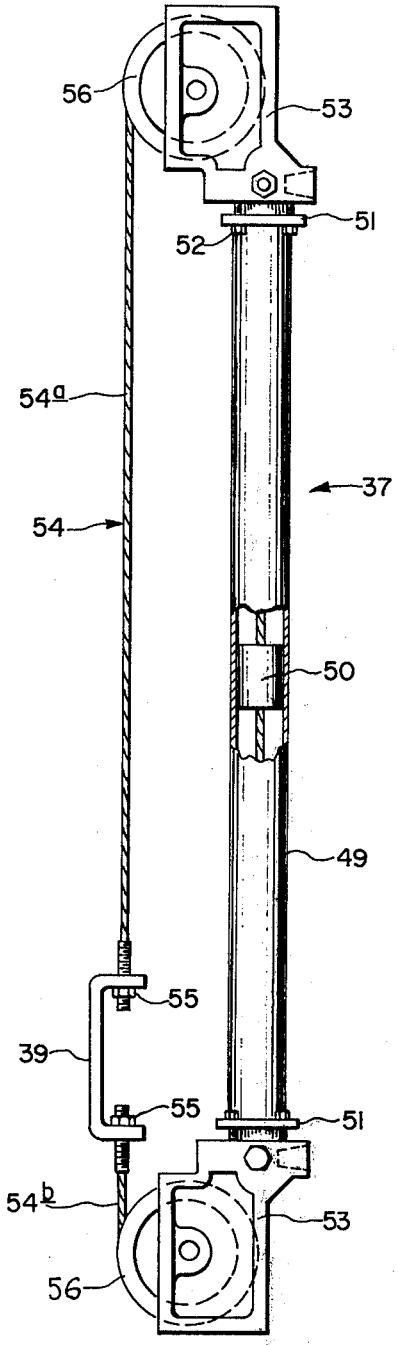
FIG. 5 is a left-hand side view of the pneumatic power source of FIG. 4.

As mentioned hereinbefore, the heater assembly 23 is moved up and down on support members 19—19 by means of the pneumatic power assembly 37. Referring now to FIGS. 4 and 5, the pneumatic power assembly includes an elongated, hollow, cylinder member 49 which contains a cylindrical, slidable piston 50 therein. The cylinder is provided with a flange member 51 at each of its ends which is provided with holes to accept bolts 52 which couple the cylinder into the pulley support members 53 at each end thereof. The base of the support members 53—53 is provided with openings therein (not shown) which are connected to a source of fluid under pressure, such as compressed air, compressed nitrogen, or oil under pressure, if desired, which is used to power the double-acting piston 50 within the cylinder 49. A flexible steel cable, designated generally 54, connects the power piston 50 to the heater assembly 23 through bracket 39. Flexible cable 54 includes an upper section **54*a* which has one end fixedly attached to the piston 50 and the other end attached to the top portion of cable bracket 39 by means of bolt 55. The lower portion 54*b* of the cable 54 is attached in a similar manner to the piston 50 and to the bracket 39 through a like bolt 55. Upper cable section 54*a* passes over pulley 56 carried by the upper pulley support member 53 and the lower cable section 54*b* passes over a like pulley 56 carried by the lower pulley support member 53. A seal ring (not shown) surrounds the cable sections 54*a* and 54*b* where they pass through the respective support members 53—53 to prevent loss of air or oil pressure from the cylinder 49.**

Figure 3:
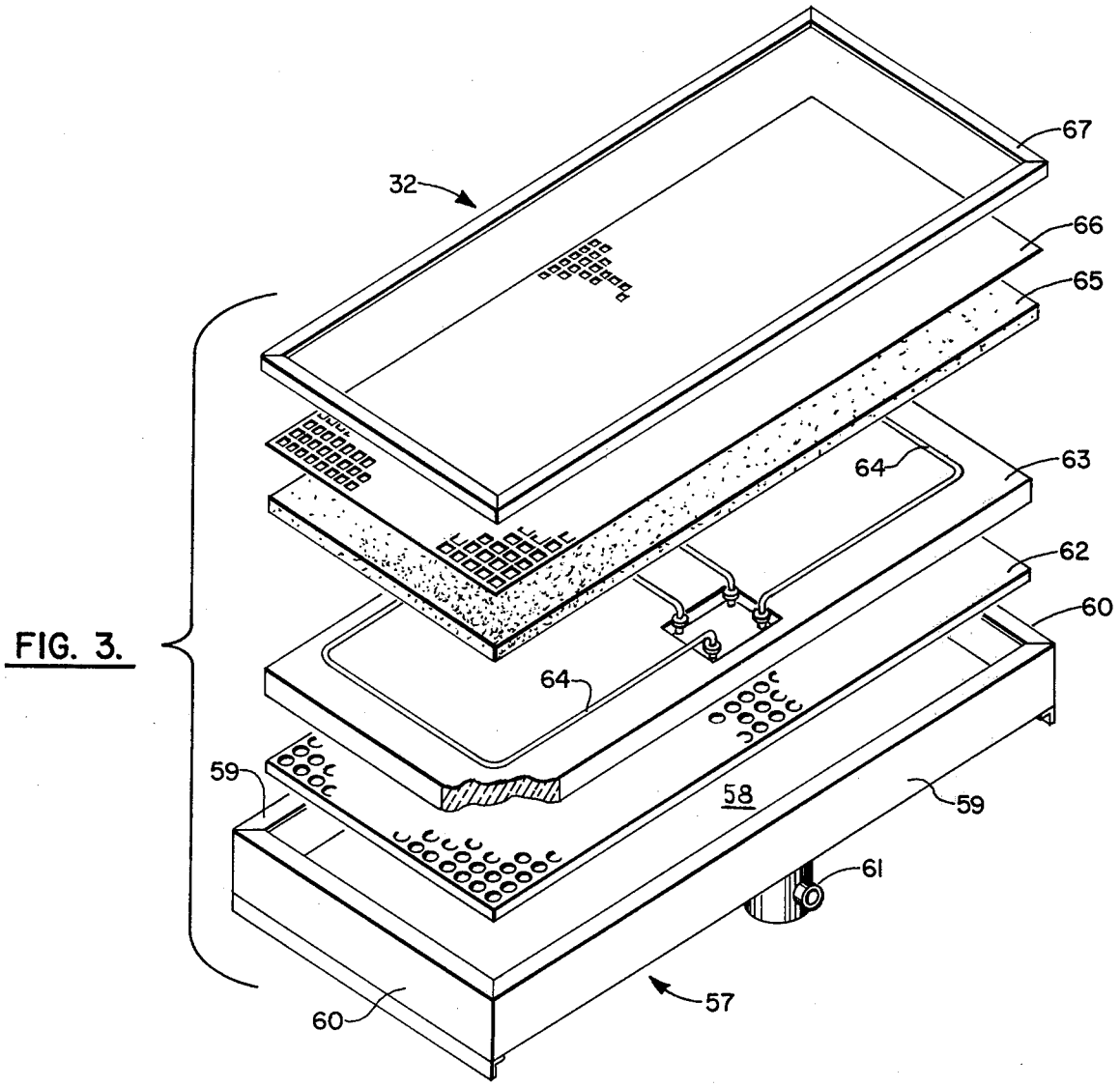
FIG. 3 is an exploded, perspective view of one of the flameless, infrared heating units utilized in the apparatus of the present invention.

Referring now to FIG. 3, the heater unit 32 is a catalytically activated, flameless, infrared, hydrocarbon fuel gas powered heater. The infrafred heater unit includes a gas tight, generally rectangular housing, designated generally by the numeral 57. The housing includes a back wall 58 and opposed longitudinal sidewalls 59—59 and opposed short end walls 60—60 which are welded or attached by other suitable means to the back wall 58. A conduit box 61 is attached to the back wall of the housing. A metal fuel disperser plate 62 is received in the housing and is seated against the back wall 58 when the device is assembled. The fuel disperser plate 62 may be made of any suitable metal with small openings therein, e.g., aluminum, steel. The next component is a porous, flameproof, combination insulation and fuel distributor pad 63. The pad 63 can be made of any nonflammable material such as porous asbestos, glasss fibers, etc. Insulated electrical heating elements 64—64 are mounted on the pad 63 and are connected to electrical energy through conduit box 61 as described hereinbefore. A porous, nonflammable, catalyst-carring pad 65 is positioned over the heating elements 64—64. This pad may be made from porous asbestos or glass fibers. The catalyst pad is protected by outer metallic screen 66, and all of the components are retained within the housing 57 by means of the locking frame 67. As pointed out hereinbefore, an assembled heating unit 32 is carried by each of the sides of the heater assembly and is adapted to direct its heat inwardly of the heater assembly.

Catalyst pad 65 is impregnated with a platinum oxide activated type catalyst which is capable of producing flameless oxidation of hydrocarbon fuels such as methane, ethane, propane, normal butane, etc. In normal burning of natural gas, ignition temperatures in the neighborhood of 1200°–14,000°F are required to maintain oxidation or combustion of the gas. However, in the flameless, infrared gas heater utilized in the present invention, the electrical heating elements 64—64 can be activated and set by means of a variable transformer (not shown) to bring the catalyst carried by the pad 65 to a temperature in the neighborhood of 225°F at which point natural gas or other hydrocarbon gases will undergo flameless oxidation within the pad 65 to produce an exceptionally efficient infrared flameless heater. Preferably, the fuel flow is regulated to produce temperatures of from about 700°F to about 1,000°F from the heater units. The infrared heater of the present invention can be made explosion proof is desired. The heater generates an extremely high percentage of infrared heat within the wavelengths of 2 to 16 microns; in particular, the device of the present invention has its maximum, i.e., over 50 percent, of its infrared heat radiated within the radiant energy range of from about 2 microns to about 6 microns. The heater of the present invention will provide a surface temperature of from about 200°F to about 700°F for an object positioned about six inches away from the face of the heater unit, depending upon the material and color. Further, the flameless heater unit used in the shrink device of the present invention provides radiant energy which is in the preferred 4 to 7 micron range that is readily absorbed with more than 90 percent efficiency by all of the ordinary plastic films used in shrink wrapping articles. Infrared, flameless gas heaters constructed in conformance with the above description and suitable for use in the film shrinking apparatus of the present invention are commercially available from a number of suppliers, e.g., Bruest, Inc., Independence, Kansas.

In carrying out the process of the present invention, the apparatus described hereinbefore is positioned at a suitable location in a warehouse or at any other packaging installation, and electrical power supplied to the control box 36, and suitable fuel gas, such as natural gas or vaporized liquefied petroleum gases, e.g., propane, butane, are supplied through the gas line 34. Compressed air or nitrogen, or oil under pressure, is supplied to the power assembly 37. Electrical controls are actuated to energize the heating elements contained in each of the heater units 32 to raise the catalyst to its operating temperature. After this temperature has been achieved, fuel gas flow is initiated and flameless oxidation of the gaseous fuel takes place within each of the heating units 32.

Figure 6:
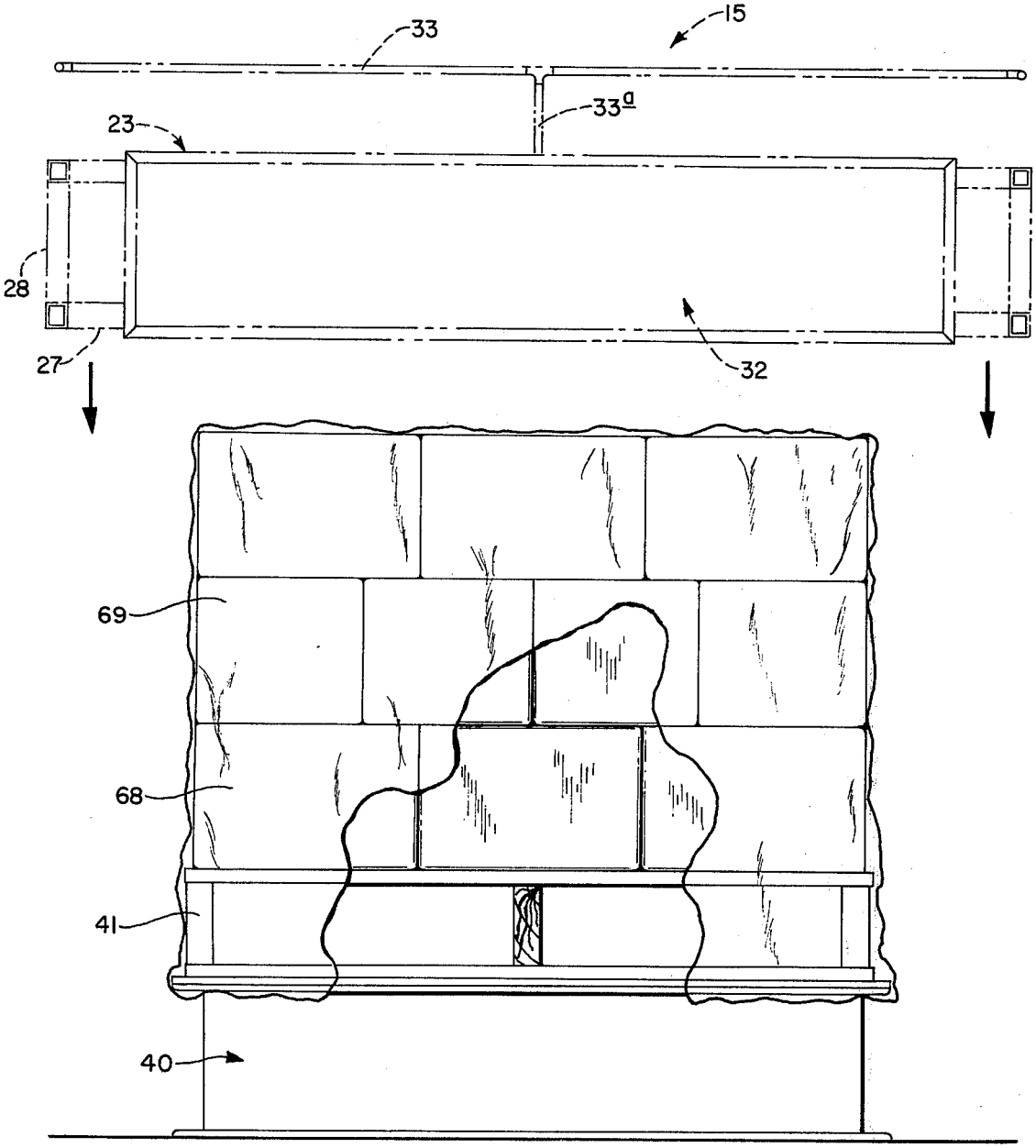
FIG. 6 is a front elevational view of the pedestal or pallet support portion of the invention shown in FIG. 1 having a pallet containing a group of products with the plastic film thereover.

Referring now to FIG. 6, a forklift truck then places a pallet 41 on the shrink apparatus pedestal 40. The pallet 41 may be of any type, the one shown in FIG. 6 being constructed from wood. The pallet supports on its upper surface a plurality of packages or articles 68 which are arranged in a generally rectangular fashion on the top of the pallet 41. Next, an operator or a machine, if desired, places a large shrinkable plastic bag 69 over the stacked articles and pulls the lower end of the bag down around the base of the pallet 41 and over the top edge of the pedestal 40. The operator then actuates the electrical switch on controlling the fans 46—46 in the pedestal and evacuates the excess air within the plastic bag through the openings 43 in the top of the pedestal and exhausts the air out the openings 45 in the sidewalls of the pedestal. This causes the bag to pull in tightly and snugly around the articles 69 in order to enhance the snugness of the fit after the bag is shrunk. Next, the operator actuates the pneumatic power assembly 37 through suitable controls (not shown) lowering the heater assembly 23 down over the plastic bag 69 surrounding the product 68. The rate of travel of the piston in the cylinder of the pneumatic power device 37 is controlled whereby the shrinking assembly 23 proceeds over the plastic encased articles 68 rapidly on its downward cycle. A very carefully controlled, slow rate of movement is taken by the shrinking assembly 23 on the upward travel cycle where the infrared heat energy is absorbed by the plastic material and the plastic bag 69 is tightly shrunk around the products 68. It can be readily experimentally determined what rate of upward movement to provide for the heater assembly 23 in order to produce a tight fit for various plastic materials of various thicknesses.

While the device is shown in exemplary form in FIG. 6 utilizing a plastic bag with one end open, it is understood that the articles 68 may be conveniently wrapped in sheets of shrinkable plastic material, one sheet looped in one direction and one sheet looped in the other direction to surround the articles on the top and four sides, and then a band or strap applied to hold the ends of the sheets around the pallet may be utilized to secure the ends of the sheet material to the pallet. Then the shrink assembly may be used to shrink and tightly bond the plastic material to the articles. Additionally, the apparatus of the present invention may be utilized to shrink film around articles which are not carried by pallets, if so desired. Suitable films for shrinking around bundled or palleted articles are polyethylene, polyvinyl chloride, polypropylene, and other suitable industrially available shrink films.

While there has been described what is at present some of the preferred embodiments of the present invention, it is understood that the scope of the present invention is limited solely by the appended claims.

What is claimed is:

1. In an apparatus for shrinking plastic film around an article or group of articles, the combination comprising:

a. a support frame having a base and a substantially vertical support member;

b. a heater assembly mounted on said vertical support member for up and down movement;

c. heater means including at least one flameless fuel gas infrared heater unit mounted on said heater assembly to direct heat inwardly, said heater unit emitting more than fifty percent of its energy as infrared energy having a wavelength of from about two to about six microns and generating temperatures in the range of from about 700°F to about 1,000°F; and d. power means mounted on said support frame and coupled to said heater assembly for moving said heater assembly up and down said power means including a double-acting, solely fluid powered assembly mounted vertically on said support frame and having a length equal to or greater than the length of the path traversed by said heater assembly during up and down movement.

2. In the apparatus of claim 1 wherein said double-acting, fluid-powered assembly includes a pneumatically powered piston received in a cylinder, said piston having flexible connector means coupling said piston to said heater assembly.

3. In the apparatus of claim 2 wherein said support frame includes a pair of spaced apart, substantially vertically extending support members and said double-acting, fluid-powered assembly is mounted between said pair of vertically extending support members and has one end attached to said base and the other end attached to the upper ends of said support members by means of a cross brace.

* * * * *